US008732957B2

(12) United States Patent
Rohrbach

(10) Patent No.: US 8,732,957 B2
(45) Date of Patent: May 27, 2014

(54) RETRACTILE-BLADE UTILITY KNIFE

(75) Inventor: Martin Rohrbach, Horn (DE)

(73) Assignee: Martor KG, Solingen (DE)

( * ) Notice: Subject to any disclaimer, the term of this patent is extended or adjusted under 35 U.S.C. 154(b) by 611 days.

(21) Appl. No.: 12/908,931

(22) Filed: Oct. 21, 2010

(65) Prior Publication Data

US 2011/0035947 A1 Feb. 17, 2011

Related U.S. Application Data

(63) Continuation-in-part of application No. 12/423,362, filed on Apr. 14, 2009, now Pat. No. 8,353,109.

(30) Foreign Application Priority Data

Apr. 17, 2008 (DE) ..... 10 2008 019 441
Oct. 22, 2009 (DE) ..... 10 2009 050 380

(51) Int. Cl.
*B26B 3/06* (2006.01)
*B26B 1/00* (2006.01)

(52) U.S. Cl.
USPC ..... 30/154; 30/162; 606/167

(58) Field of Classification Search
CPC ..... B26B 1/08; B26B 5/00; B26B 5/001; B26B 5/002; B26B 5/003; B26B 5/005
USPC ..... 30/2, 154, 162, 164, 335, 336, 151; 606/167
See application file for complete search history.

(56) References Cited

U.S. PATENT DOCUMENTS 5,391,177 A * 2/1995 Schwartz ..... 606/167
6,148,520 A * 11/2000 Berns ..... 30/2

* cited by examiner

*Primary Examiner* — Kenneth E. Peterson
*Assistant Examiner* — Samuel A Davies
(74) *Attorney, Agent, or Firm* — Andrew Wilford

(57) ABSTRACT

A knife has a housing, an operating part shiftable on the housing between advanced and retracted positions, and a blade holder connected to the part and carrying a blade. The holder is shiftable on the part between offset first and second cutting positions with the blade projecting from the front end and a safety position with the blade recessed in the housing rearward of the front end. A spring biases the holder into the safety position. A brace element can shift between a position braced between the blade holder and the housing in the first cutting position and a position out of engagement with the blade holder or the housing in the second cutting position. The brace element when engaged holds the blade in the first cutting position but in the second cutting position is disengaged so the spring returns the holder to the safety position.

12 Claims, 4 Drawing Sheets

RETRACTILE-BLADE UTILITY KNIFE

CROSS REFERENCE TO RELATED APPLICATIONS

This application is a continuation-in-part of copending U.S. patent application Ser. No. 12/423,362 filed 14 Apr. 2009 with a claim to the priority of German patent application DE 10 2009 019 441.7 itself filed 17 Apr. 2008.

FIELD OF THE INVENTION

The present invention relates to a utility knife. More particularly this invention concerns such a knife with a retractile blade.

BACKGROUND OF THE INVENTION

Such a knife is known from U.S. Pat. No. 6,148,520 where the knife has a blade holder mounted in the knife housing for displacement in a straight line. The blade holder can be moved by a slide between a rear retracted and a front use position.

OBJECTS OF THE INVENTION

It is therefore an object of the present invention to provide an improved retractile-blade utility knife.

Another object is the provision of such an improved retractile-blade utility knife that overcomes the above-given disadvantages, in particular that is particularly safe, easy to manufacture, and useful.

A further object is to provide such a retractile-blade utility knife that is of particularly compact construction.

SUMMARY OF THE INVENTION

A knife has according to the invention a housing having a front end, an operating part shiftable on the housing between an advanced position and a retracted position, and a blade holder connected to the part and carrying a blade. The holder is shiftable on the part in the advanced position thereof between a first cutting position with the blade projecting from the front end, a second cutting position offset from the first cutting position and with the blade also projecting from the front end, and a safety position with the blade recessed in the housing rearward of the front end so that a cutting force applied to the blade in the first cutting position shifts the blade into the second cutting position. A spring biases the holder into the safety position. A brace element can shift between an engaged position braced between the blade holder and the housing in the first cutting position and a disengaged position out of engagement with the blade holder or the housing in the second cutting position so that the brace element in the engaged position holds the blade in the first cutting position but in the second cutting position the brace element is disengaged and the spring returns the holder to the safety position.

The invention is configured such that the blade holder can be moved by an actuating device, particularly from a safety position in which the blade is recessed in the housing and inaccessible for the user, into a cutting position with the blade projecting from the knife housing.

The blade holder is mounted to be able to move in a straight line or in an arc, that is to slide or be pivoted. Due to the pivotal mounting, the part of the actuating device that works with the blade holder can execute a complex movement with, for example movement components in two spatial directions.

This can involve, for example a compound movement made of a pivoting movement and a translatory movement. The area of the actuating element working with the blade holder is consequently not limited to movement in a straight line, as is the case in the prior art. The actuating element can for example pivot, the blade holder working with the actuating element executing an angular pivot movement and a linear movement.

The actuating device has at least one operating part and at least one actuating element for actuating the blade holder. The actuating element can be for example moved by the operating part from a starting position into a first pivot position. The operating part is moved for example from a retracted position into an advanced position in order to move the actuating element from the starting position into the first pivot position.

The actuating element can for example be formed by an actuating link which works with the blade holder. The blade holder is, for example pivotal with respect to the actuating link. The actuating link pivots through a certain pivot angle upon movement between the starting position and a first pivot position, and in the process moves the blade holder from the safety position into the first cutting position.

The actuating element is for example mounted on the housing. It can be directly or indirectly mounted in the housing. The actuating element can, for example be mounted on the operating part. By means of the operating part, the actuating element can, for example be actuated directly or indirectly. The operating part and the actuating element can, for example be formed by separate elements. Alternatively, the operating part and the actuating element can, for example be formed by one component. The operating part can, for example form part of the actuating element. The operating part can, for example form a part of the housing. The actuating element can for example be mounted on the operating part.

According to the invention, the actuating device is pivoted on the blade holder. For example the actuating element can be pivoted on the blade holder. The actuating element can for example be connected to the blade holder in a fixed manner. Alternatively, the actuating element can, for example connect with the blade holder in a releasable manner. Then, when connected, the blade holder and the actuating element can pivot with respect to each other.

The blade holder is mounted on the housing to be able to move in a translatory manner and/or in a rotating manner. According to the invention, "translatory" movement means that the blade holder can move along a guide. The guide can for example be straight or curved or have straight or curved partial segments.

The advantage of the invention is that the knife has only few parts, and that a simple construction is possible. The knife, in this way, can be easily manufactured and results in minimal manufacturing costs. Moreover, the knife according to the invention has a high degree of functional safety.

Particularly, the components of the knife, the knife housing, operating part, actuating device, blade holder with blade, and optionally a pawl, can form elements of a linkage. In this way, it is possible to obtain a certain movement characteristic of the blade holder during the movement from the safety position and the at least one cutting position by the design of this linkage elements. The actuating device can, for example together with the operating part and the blade holder, form a parallelogrammatic linkage. The actuating device can, for example have two arms which are mounted in a hinged manner to the operating part and to the blade holder.

Because the blade holder, for example upon the movement from the second cutting position into the safety position, pivots toward the material being cut, the friction force between the blade and material being cut increases during cutting. In this way, it is possible to cut very thin materials, such as, for example films or foils.

Moreover, extension of the blade support upon actuation of the operating part for example can be determined via the design of the linkage elements.

Due to the mounting of the blade holder, which enables a translatory movement and a pivoting movement, it is possible to design the knife in a simple manner such that both a cutting force parallel to the cutting edge of the blade and also a cutting force working transverse to the blade effect a movement of the blade holder from the first cutting position into the second cutting position.

According to the invention, a pawl is provided that braces the blade holder against the housing in a releasable manner. The pawl can, for example be mounted on the blade holder or on the housing. The pawl braces the blade holder against the housing in a releasable manner. Upon movement of the blade holder from the starting position into a first pivot position, the pawl can for example engage with the housing or be moved while engaged with the housing. The pawl as such limits for example the degree of freedom of the blade holder such that the blade holder is forced into the first pivot position. The pawl can for example fit with a rest or seat.

Within this description of the invention, the term "pawl" can mean an element that transmits tensile or compressive stress in a resistant manner.

In the event that the blade holder moves from a first cutting position into a second cutting position, for example by a cutting reaction force, then the pawl can be moved, by the blade holder movement, into a disengaged position. The blade holder then once again has an additional degree of freedom, which enables the same to move back into the housing, even though the operating part is actuated.

A particular movement can be determined for the blade holder by the pawl. A space between the blade holder and the housing can be bridged by the pawl. In addition, a safety function can be provided by the pawl in that the blade moves back into the housing when the operating part is in the advanced position and if the cutting reaction force on the blade exceeds a certain value. This is possible, for example because the pawl can be engaged in a releasable manner. The release of the engagement of the pawl can, for example result from the cutting reaction force (also termed "cutting force").

According to a first embodiment, the actuating device has an actuating element designed as a link pivoted on a part of the housing. The actuating element can be mounted to a moving part of the knife. For example the actuating element can be mounted on the operating part. The actuating element can be pivoted from a starting position into a first pivot position when the operating part is moved from the retracted position into an advanced position.

According to an additional embodiment, the actuating element is pivoted on the blade holder. The blade holder is movable relative to the actuating element. The blade holder and the actuating element can assume various angular positions relative to each other.

According to an additional embodiment, the operating part is mounted on the actuating element. The operating part can be designed as one part together with the second end. The operating part can, for example be formed by part of the actuating link. Alternatively, the operating part can, for example be designed as a separate component and work with the actuating element. The operating part can for example work with the actuating element in a releasable manner. A first end area of the actuating element can, for example be connected to the blade holder, and a second end area of the actuating element can be connected to the operating part.

In an additional embodiment according to the invention, the actuating element is mounted on the operating part. The actuating element can, for example be fixedly connected to the operating part by a link. The actuating element can, for example be pivoted on the operating part. On movement of the operating part from the retracted position into the advanced position, the actuating element, which is connected to the operating part, moves together with the operating part along the same path.

In an additional embodiment according to the invention, the operating part is formed by a link pivoted on the housing, the operating part being pivotal at least between one advanced position and one retracted position. In this way, the operating part can pivot relative to the housing, the actuating element being for example moved from a starting position into a first pivot position.

In an additional embodiment according to the invention, the operating part is biased by a spring into the retracted position. As such, the operating part is automatically moved into the retracted position as soon as the operator ceases to exert force on the operating part.

In an additional embodiment, a pawl in mounted on the blade holder or on the housing. This pawl braces the blade holder against the housing, at least in the first cutting position, in a releasable manner. The pawl can limit the degree of movement of the blade holder. It can form point about which the actuating element can pivot like a see-saw. The pawl can, for example be attached to the actuating element and be brought into engagement with the housing at least indirectly. The pawl can for example work with a stop attached to the housing. Alternatively, the pawl can, for example be attached to the housing, and can be so designed as be able to be brought into engagement with the blade holder. A stop can for example be provided on the blade holder, interacting with the pawl.

According to an additional embodiment, a stop attached to the housing is provided, and the blade holder is supported on the stop. By utilizing this stop, the blade holder can be forced to follow a certain path of movement. This stop moves the blade holder from a retracted position into an advanced position, from a safety position into a first cutting position, on actuation of the operating part. In the cutting position, the blade holder projects out of the housing. The stop can, for example be molded onto the housing. The stop can for example work with the pawl that for example is attached to the blade holder.

In an additional embodiment, the pawl can be brought into a releasable engagement with the housing or the blade holder. With this embodiment, the degree of freedom of the blade holder can be limited in a particular way when the pawl is engaged, and the blade holder can be released again by releasing the pawl. The blade holder can for example move from the second cutting position back in the direction of the safety position when the pawl is disengaged, independently of whether the operating part is at that moment in the advanced position. The actuating element that moves together with the blade holder can be moved into the starting position when the blade holder moves into the safety position.

According to an additional embodiment, the pawl can only be brought into engagement with the housing or the blade holder in a pressure-tight manner. In the case of this embodiment, the engagement of the pawl with the housing or with the blade holder can be released in a simple manner. Release of the pawl from the engagement can be effected for example by a pivoting or a translatory movement of the blade holder.

According to an additional embodiment, the pawl is an approximately rod-shaped. A distance for example between the actuating element and the housing can be bridged by this rod shape.

According to an additional embodiment, the pawl is pivoted on the blade holder. Due to the pivotal mounting of the brace pawl on the blade holder, the blade holder can come into engagement with the housing in multiple positions. If the pawl moves out of engagement with the housing, it can be pivoted into a position in which an undesired, new engagement with the housing is prevented, as long as the operating part is in the advanced position.

According to an additional embodiment, a bearing seat is constructed on the housing or on the blade holder, and the pawl can be brought into a releasable engagement with this bearing seat. The bearing seat can for example be formed by a recess, for example by a notch, and an undesired release of the pawl from the engagement can be prevented by this notch. Upon movement of the actuating device from the starting position into the first pivot position, the pawl can be arranged in the notch. Upon movement of the actuating device from the first pivot position into the second pivot position, the pawl can move out of the notch and in this way lose contact with the housing or to the blade holder.

According to an additional embodiment, at least one guide surface is constructed neighboring the opposing surface, and the guide surface guides the pawl into engagement with the opposing surface, particularly the bearing seat. Two guide surfaces can, for example be provided, with a first guide surface guiding the pawl into the recess during movement of the blade holder into the first cutting position.

Once the pawl is released from engagement with the recess, the blade holder can, for example when the operating part is actuated, move back in the direction of the starting position. In this case, the pawl can, for example abut the second guide surface, which in turn guides the pawl to the first guide surface.

According to an additional embodiment of the invention, the pawl is urged by at least one spring to maintain the pawl in a neutral position. When the pawl pivots in at least one rotational direction, the pawl is then placed under load and returns as a result to the neutral position. If, following the engagement of the pawl with the stop element, the blade holder moves into the first cutting position, the pawl can then pivot with respect to the actuating element, and so can place tension on the spring. The spring can be formed by for example a tension spring, a pressure spring, or by another suitable spring. The spring can for example be molded to the blade holder and constructed as a unitary component with it.

According to an additional embodiment, the blade holder is mounted on the housing in a moving and/or rotating manner, either directly or indirectly. The blade holder can for example be provided with at least one guide element, corresponding to a guide structure of the housing or of the operating part. The guide element can for example be formed by a pivot stud itself received in a guide channel or in a slotted link.

According to an additional embodiment, the blade holder can be moved from the safety position into a first cutting position in which the blade projects out of the housing. And by an additional movement, the blade holder can be moved from the first cutting position into at least one second cutting position. The blade holder can be moved back into the safety position from the second cutting position. Positions of the actuating element and the pawl can be related to the various positions of the blade holder. For example movement from the first cutting position into the second cutting position controls movement of the actuating element and/or the pawl. The movement of the blade holder from the first cutting position into the second cutting position can for example be effected by the cutting force acting on the blade during the cutting action, if the blade moves into the material being cut.

Between the safety position and first cutting position, the blade holder can, for example by the pawl, be supported on the housing. By means of the movement into the second cutting position, the pawl can for example disengage from the housing or from the blade holder.

According to an additional embodiment of the invention, the pawl is in an engaged state when the blade holder is moved into the first cutting position, and the pawl is in a disengaged state when the blade holder is moved into the second cutting position, movement of the blade holder into the safety position being prevented if the operating part is moved into the advanced position when the pawl is engaged, and movement of the blade holder into the safety position being possible when the pawl is disengaged. By movement of the blade holder from the first into the second cutting position, the actuating element can for example be moved from a first pivot position into a second pivot position. By movement of the actuating element into the second pivot position, the pawl for example can be moved out of engagement with the housing or with the actuating element.

According to an additional embodiment, the blade holder is mounted in such a manner that a cutting force working on the blade effects a translatory and/or a pivot movement of the blade holder, the blade holder being moved from the first cutting position into the second cutting position. By translatory movement and/or the pivot movement of the blade holder, the actuating element for example is moved from the first pivot position into the second pivot position.

According to an additional embodiment, a cavity is formed by a knife housing and the operating part together. The cavity part of the housing and the cavity part of the operating part are connected to each other. The housing and the operating part form for example the housing of the knife. For example the actuating element can be at least partially arranged in the cavity of the operating part. A spring that urges the actuating element so as to maintain it in the starting position can for example be arranged in the seat of the operating part.

In this way, the construction of the knife can comprise a flexible design because an additional seat is available in is which functional components of the knife can be received.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
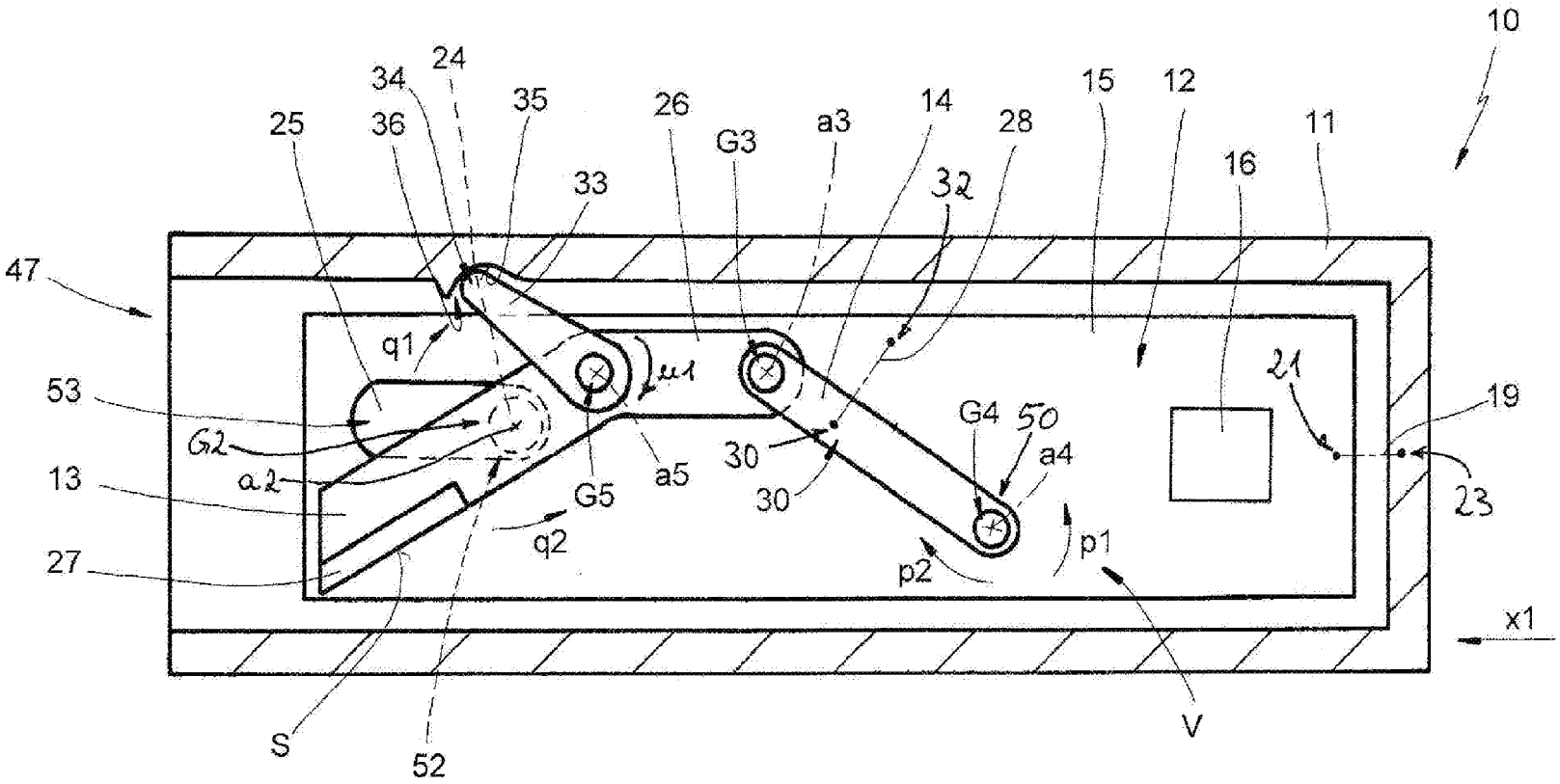
FIG. 1 is a partly schematic sectional view of the knife according to the invention with the blade in the safety position and the slide in the unactuated or retracted position.

As seen in FIG. 1, a knife 10 has an elongated housing 11, an operating part formed by a slide 12, a blade holder 13 and an actuating element 14. The slide 12 and the actuating element 14 form part of an actuating means V.

The slide 12 has a rear end 15 provided with an is actuating bump or recess 16 accessible through an unillustrated slot in the housing 11. The slide 12 can shift longitudinally in the housing 11 in forward and rearward directions x1 and x2 between a rear retracted position shown in FIG. 1 in which it is spaced rearward of a front end face 47 of the housing 11 and a front advanced position shown in FIG. 2 with its front end basically flush with the housing front end 47. A tension spring 19 has a front end hooked at 21 to the slide 12 and a rear end hooked at 23 to the housing 23 to bias the slide 12 rearward into the retracted position.

A cylindrical pivot stud 24 formed on the blade holder 13 is guided in a longitudinally extending groove 25 formed in the slide 12. A link G2 thus connects the blade holder 13 to the housing 11. In this way, the blade holder 13 can be displaced in the directions x1 and x2 parallel to a longitudinal axis m of the groove 25 and can pivot about an axis a2 of the pivot stud 24 in the directions q1 and q2 (FIG. 1). More particularly, the blade holder 13 can pivot about the axis a2 between a safety position (FIGS. 1 and 4), a first cutting position (FIG. 2) and a second cutting position (FIG. 3). The blade holder 13 has an unillustrated seat for a blade 27.

Figure 3:
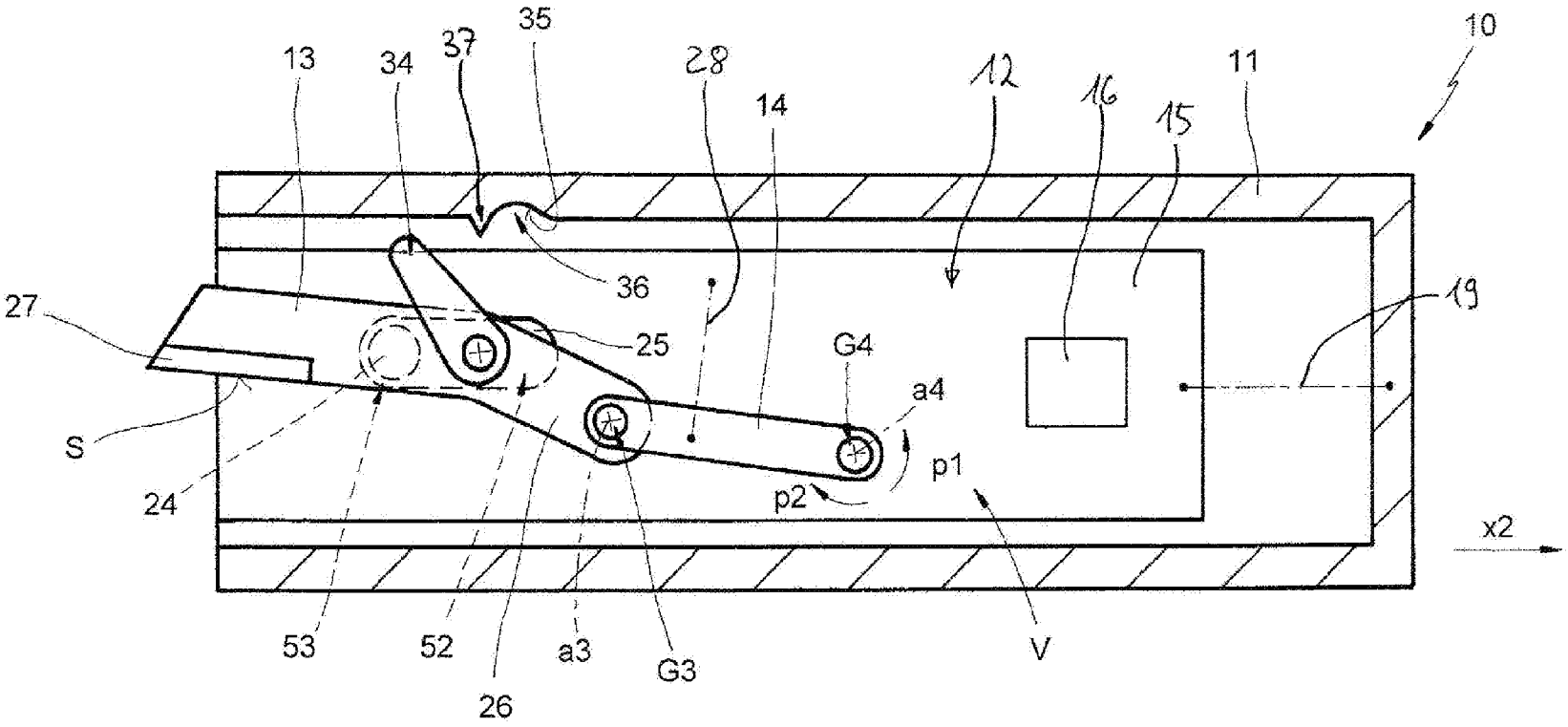
FIG. 3 is a view like FIG. 1 but with the blade in the second cutting position and the slide in the advanced position.
Figure 4:
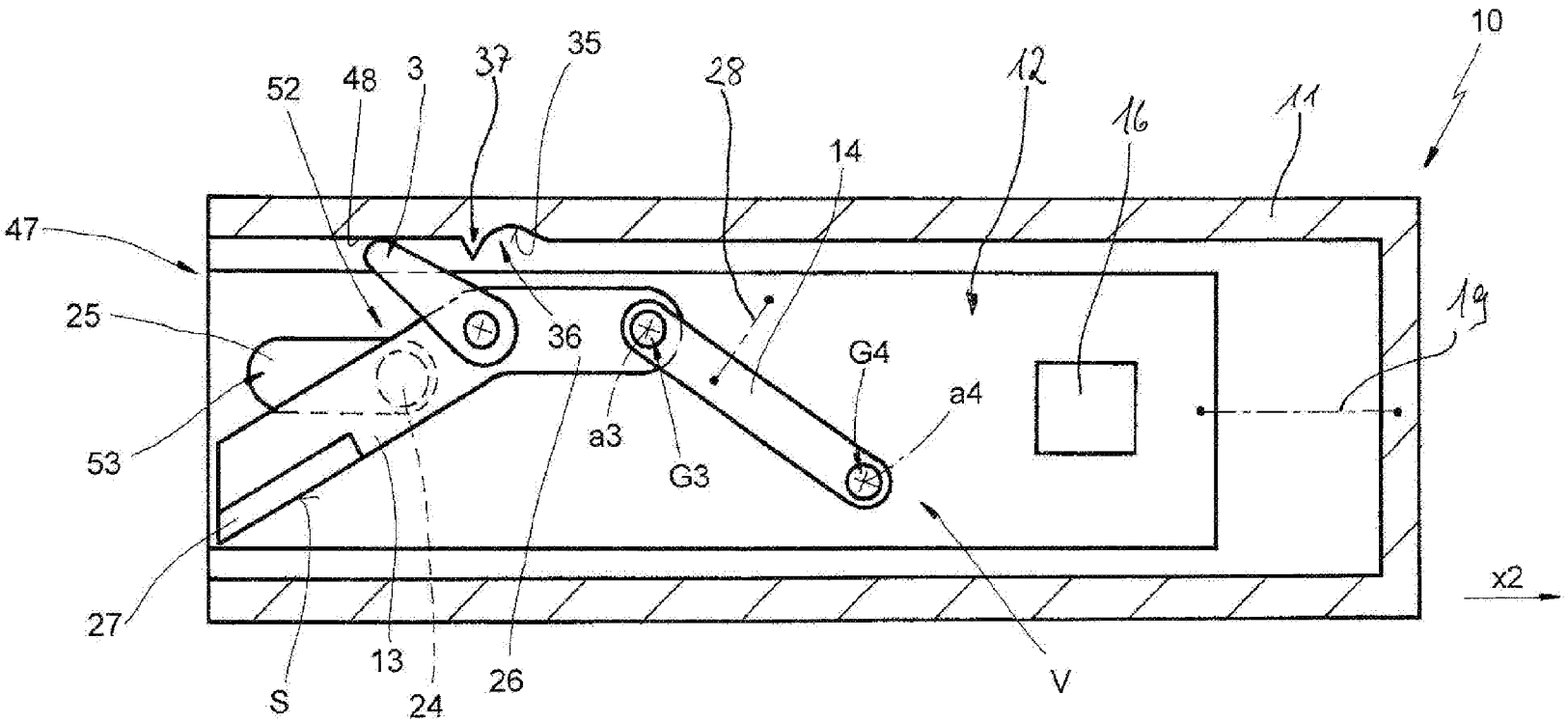
FIG. 4 is a view like FIG. 1 but with the blade in the safety position and the slide in the advanced position.

When the slide 12 is in the rear position of FIG. 1, the blade 27 is retracted into the housing 11 and the knife can safely be pocketed or handled. When the slide 12 is in the front advanced position and the blade holder 13 is in the first cutting position or in the second cutting position, the blade 27 projects out of the housing 11 (see FIG. 2 and FIG. 3) and the knife can be used for cutting. But, as shown in FIG. 4, when the slide 12 is in the front advanced position but the blade holder 13 is in the safety position, the blade 27 is retracted into the housing 11.

A rear extension 26 of the blade holder 13 is connected to a front end 49 of the actuating element 14 at a pivot G3 having a pivot axis a3 extending transversely of the directions x1 and x2 and parallel to the axis a2. Thus the holder 13 is shaped as a wide V but the pivot axis a2 is not at the apex, but between the apex and the blade 27. The rear extension 26 is connected at its rear end to the slide 12 at a pivot G4 having a pivot axis a4 parallel to the axes a2 and a3. In this way, the actuating element 14 can pivot in directions p1 and p2 relative to the slide 12. A biasing element, for instance a tension spring 28, urges the actuating element 14 into a starting position shown in FIG. 1 in which the actuating element 14 holds the blade holder 13 in the safety position. The spring 28 is attached at 30 to the actuating element 14 and at 32 to the slide 12.

A brace pawl 33 is pivoted on the blade holder 13 at a pivot G5 having an axis a5 parallel to the axes a2, a3, and a4 and lying between the axis a2 and the axis a3 at the apex of the V-shaped holder 13. In the FIG. 1 starting position of the is actuating element 14 an outer end 34 of the pawl 33 engages a surface 35 of a recess 36, thereby bracing the holder 13 rearward of its pivot axis a2 against the housing 11. The spring 28 maintains this position. An unillustrated torsion spring at the axis a4 biases the pawl 33 in the direction q1.

Figure 2:
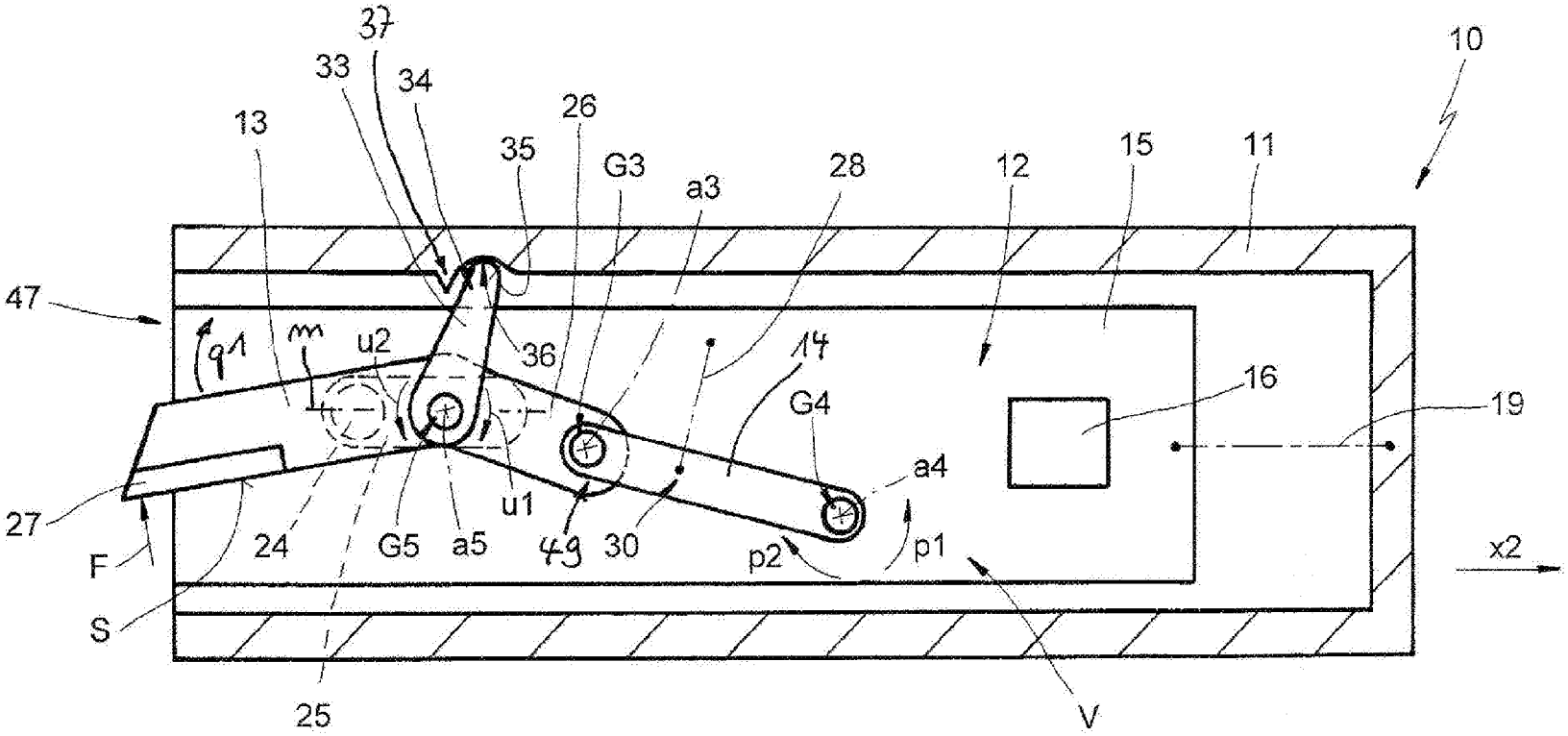
FIG. 2 is a view like FIG. 1 but with the blade in the first cutting position and the slide in the actuated or advanced position.

If the slide 12 is slid from the retracted position of to FIG. 1 in the direction x1 into the advanced position according to FIG. 2, the end 34 of the pawl 33 bears against the surface 35 of recess 36, in particular against a back flank of a V-shaped projection 37 forward of the recess 36. This causes the link or actuating element 14 to pivot counterclockwise in direction p1 about its axis a4 and the holder 13 to pivot clockwise in direction q1 about its axis a2, thereby moving from the FIG. 1 safety position to the FIG. 2 first cutting position. The pawl 33 is therefore subject to compression between its outer end engaging the surface 35 of the recess 36 and its inner end at the pivot G5. During this action, of course, the stud 24 slides from a rear end 52 to a front end 53 if the slot 25.

In the position of FIG. 2, the blade 27 projects out of the front end 47 of the knife 10. The pawl 33 has meantime been pivoted in direction u1 against the force of its unillustrated biasing spring.

If a force F resultant from cutting is effective on the blade 27 to pivot the holder 13 in the direction q1 when in the FIG. 2 first cutting position, the holder 13 will be pivoted limitedly in the direction q1 about its axis a2 into the second cutting position of FIG. 3 where it will be arrested by an unillustrated stop or abutment. This action will, however, pivot the axis a5 in the direction q1 about the axis a2 and will pull the outer end 34 of the pawl 33 out of the recess 36, whereupon the unillustrated torque spring will pivot the pawl 34 forward in the direction q2 to the position shown in FIG. 3 in which it is clear of any structure. In this position, cutting can proceed so long as the force F is maintained.

If, however, starting from the FIG. 3 position with the slide 12 advanced and the pawl 33 disengaged from the recess 36, if there is no more force F exerted against the blade 27 or the force exerted in direction q1 on the blade holder 13 is less than the force exerted on it in the opposite direction q2 by the spring 28, the spring 28 will pivot the actuator link 14 about the axis a4 in the direction p2 and thereby pivot the holder 13 bout the axis a2 in the direction q2 to the safety position shown in FIG. 4, in which it is wholly retracted into the housing 11. Thus even though the user might still be gripping the knife 10 and holding the slide 12 in the advanced position, the blade 27 is retracted and the likelihood of an accident with it is reduced to zero.

Thus if the user pushes the slide 12 forward by, for instance engaging his/her thumb against the formation 16 and pushing it in direction x1, the parts will move into the first cutting position of FIG. 2 with the blade 27 projecting from the housing front end 47. Then as a component of the cutting force F is exerted on the blade 27 in the indicated direction transverse to the axis m, the holder 13 pivots into the position of FIG. 3 so long as the blade 27 is pressed against the workpiece. As soon as the force F ends, the blade 27 automatically retracts into the FIG. 4 safety position, even though the slide 12 is still in the advanced position so that the knife 10 is in effect on safety. In this FIG. 4 position the outer end 34 of the pawl 33 bears against an inner face of the housing 11.

The only way to get the blade 27 to stick out again is to move the slide 12 back in direction x2 to the starting position or release the slide 12 and let the spring 13 pull it back. During this rearward movement the outer end 34 of the pawl 33 slides along the inner surface 48 until it seats again in the recess 36. Then the user can push the slide 12 forward again to extend the blade 27.

I claim:

1. A knife comprising:

a housing having a front end;

an operating part movable on the housing between an advanced position and a retracted position;

a blade holder connected to the operating part, carrying a blade, and movable relative to the operating part in the advanced position thereof between a first cutting position with the blade projecting from the front end, a second cutting position offset from the first cutting position and with the blade also projecting from the front end, and a safety position with the blade recessed in the housing rearward of the front end, whereby a cutting force applied to the blade in the first cutting position moves the blade into the second cutting position;

spring means for biasing the holder into the safety position; and a brace element movable between an engaged position braced between the blade holder and the housing in the first cutting position and a disengaged position out of engagement with the blade holder or the housing in the second cutting position such that movement of the blade holder into the second cutting position in the advanced position of the operating part moves the brace element into the disengaged position so the blade holder can move into the safety position without movement of the operating part from the advanced position and such that in the engaged position the brace element holds the blade in the first cutting position but in the second cutting position the brace element is disengaged and the spring means can return the blade holder to the safety position while the operating element remains in the advanced position; and an actuating link engaged between the operating part and the blade holder.

2. The knife defined in claim 1 wherein the actuating link is pivoted on the operating part and on the blade holder.

3. The knife defined in claim 2 wherein the operating part is pivotal between the advanced and retracted positions.

4. The knife defined in claim 2 wherein the operating part is slidable in a generally straight line between the advanced and retracted positions.

5. The knife defined in claim 2 wherein the blade holder is pivoted at a holder pivot axis on the operating part.

6. The knife defined in claim 5 wherein the blade holder has a front end carrying the blade and a rear end pivoted on the actuating link.

7. The knife defined in claim 6 wherein the brace element is engaged with the blade holder offset from the holder pivot axis.

8. The knife defined in claim 7 wherein the brace element is pivoted on the blade holder offset from the holder pivot axis.

9. The knife defined in claim 8 wherein the housing is formed with a recess in which an outer end of the brace element is engageable.

10. The knife defined in claim 5 wherein the holder pivot axis is fixed relative to the blade holder and moveable along the operating part.

11. The knife defined in claim 10 wherein the holder pivot axis is formed by a stud and the operating part is formed with a guide in which the stud can slide.

12. A knife comprising:

a housing having a front end;

an operating part movable on the housing between an advanced position and a retracted position;

a blade holder connected to the operating part, carrying a blade, and movable relative to the operating part in the advanced position thereof between a first cutting position with the blade projecting from the front end, a second cutting position offset from the first cutting position and with the blade also projecting from the front end, and a safety position with the blade recessed in the housing rearward of the front end, whereby a cutting force applied to the blade in the first cutting position moves the blade into the second cutting position;

spring means for biasing the holder into the safety position;

a brace element movable between an engaged position braced between the blade holder and the housing and a disengaged position disengaged from the housing such that movement of the operating part from the retracted position into the advanced position moves the brace element into the engaged position and the blade holder into the first cutting position and movement of the blade holder into the second cutting position in the advanced position of the operating part moves the brace element into the disengaged position so the blade holder can move into the safety position with the operating part in the advanced position; and an actuating link engaged between the operating part and the blade holder.

* * * * *